US010453387B2

(12) United States Patent
Zhou et al.

(10) Patent No.: US 10,453,387 B2
(45) Date of Patent: Oct. 22, 2019

(54) DISPLAY PANEL, DISPLAY DEVICE, PIXEL DRIVING CIRCUIT, AND CONTROL METHOD FOR THE SAME

(71) Applicant: SHANGHAI TIANMA MICRO-ELECTRONICS CO., LTD., Shanghai (CN)

(72) Inventors: Xingyao Zhou, Shanghai (CN); Chang-ho Tseng, Shanghai (CN); Yuan Li, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 15/865,186

(22) Filed: Jan. 8, 2018

(65) Prior Publication Data

US 2018/0130411 A1 May 10, 2018

(30) Foreign Application Priority Data

Aug. 18, 2017 (CN) ..... 2017 1 0713474

(51) Int. Cl.
*G09G 3/3225* (2016.01)
*G09G 3/3233* (2016.01)
*G09G 3/3241* (2016.01)

(52) U.S. Cl.
CPC ..... *G09G 3/3225* (2013.01); *G09G 3/3233* (2013.01); *G09G 3/3241* (2013.01); *G09G 2300/0426* (2013.01); *G09G 2300/0819* (2013.01); *G09G 2300/0842* (2013.01); *G09G 2300/0861* (2013.01); *G09G 2310/0262* (2013.01); *G09G 2310/061* (2013.01); *G09G 2310/08* (2013.01); *G09G 2320/0233* (2013.01); *G09G 2320/045* (2013.01)

(58) Field of Classification Search
CPC combination set(s) only.
See application file for complete search history.

(56) References Cited

U.S. PATENT DOCUMENTS 7,545,354 B2 6/2009 Ha
9,646,536 B2 * 5/2017 Qian ..... G09G 3/3258
(Continued)

FOREIGN PATENT DOCUMENTS

CN 106297659 A 1/2017
KR 10-2017-0003464 * 1/2017 ..... G09G 3/3275

*Primary Examiner* — Priyank J Shah
(74) *Attorney, Agent, or Firm* — Kilpatrick Townsend & Stockton LLP

(57) ABSTRACT

A display panel, a display device, a pixel driving circuit, and a control method for the pixel driving circuit. The pixel driving circuit includes a data writing module for transmitting signal of the data signal end to the first node in response to enable signal of the first control signal end; a coupling writing module for transmitting signal of the first power source voltage end to the first node in response to enable signal of the second control signal end; a storage capacitor; a driving transistor; a first switch unit; a second switch unit; a reset module for transmitting signal of the reset signal line to the fourth node in response to enable signal of the fifth control signal end; and a light emitting element, an anode thereof being electrically connected to the fourth node, an cathode thereof being electrically connected to a second power source voltage end.

14 Claims, 10 Drawing Sheets

(56) References Cited

U.S. PATENT DOCUMENTS

| | | | | |
|---|---|---|---|---|
| 2003/0234392 | A1* | 12/2003 | Kung | G09G 3/3233 257/13 |
| 2012/0105427 | A1* | 5/2012 | Senda | G09G 3/3233 345/212 |
| 2014/0145917 | A1* | 5/2014 | Kwak | G09G 3/3233 345/82 |
| 2014/0152719 | A1* | 6/2014 | Jung | G09G 3/3233 345/691 |
| 2016/0104423 | A1* | 4/2016 | Park | G09G 3/3233 345/78 |
| 2016/0351121 | A1* | 12/2016 | Kim | G09G 3/3233 |
| 2016/0351123 | A1* | 12/2016 | Qing | G09G 3/3275 |
| 2017/0365215 | A1* | 12/2017 | He | G09G 3/20 |
| 2018/0061324 | A1* | 3/2018 | Kim | G09G 3/3275 |
| 2018/0114487 | A1* | 4/2018 | He | G09G 3/3258 |
| 2018/0197484 | A1* | 7/2018 | Moon | G09G 3/3275 |
| 2018/0357959 | A1* | 12/2018 | Xiang | G09G 3/3233 |

* cited by examiner

DISPLAY PANEL, DISPLAY DEVICE, PIXEL DRIVING CIRCUIT, AND CONTROL METHOD FOR THE SAME

CROSS-REFERENCE TO RELATED APPLICATIONS

The present application claims the benefit of priority to Chinese Patent Application No. 201710713474.4, filed on Aug. 18, 2017, the content of which is incorporated herein by reference in its entirety.

TECHNICAL FIELD

The present disclosure relates to the field of display technologies and, particularly, relates to a display panel, a display device, a pixel driving circuit, and a control method for the pixel driving circuit.

BACKGROUND

Among the display technologies, Organic Light-Emitting Diode (OLED) is regarded in the industry as the third-generation display technology subsequent to Liquid Crystal Display (LCD) due to its advantages of a thin and light characteristic, active luminescence, fast response speed, wide visual angle, abundant colors, high brightness, low power consumption, high and low temperature resistance and the like.

At present, OLED displays are mainly displays that emit light under the control of electric current, and the luminescence uniformity is controlled by the corresponding electric current. However, because the threshold voltage of the drive transistor of each pixel of the OLED display tends to be drifted over time, the electric current passing through the OLED may be deviated under the same data signal, which causes non-uniform brightness in displaying. Further, the luminous efficiency of the OLED device itself may degrade over time, and thus the brightness may be lowered under the same electric current, thereby lowering the display effect of the display.

SUMMARY

The embodiments of the present disclosure provides a display panel, a display device, a pixel driving circuit and a control method for the pixel driving circuit, which can alleviate the problem of non-uniform display.

In one aspect, the present disclosure provide a pixel driving circuit, including: a data writing module, a coupling writing module, a storage capacitor, a driving transistor, a first switch unit, a second switch unit, a reset module, and a light emitting element. The data writing module is electrically connected to a data signal end, a first control signal end and a first node, and used for transmitting a signal of the data signal end to the first node in response to an enable signal of the first control signal end. The coupling writing module is electrically connected to a first power source voltage end, a second control signal end and the first node, and used for transmitting a signal of the first power source voltage end to the first node in response to an enable signal of the second control signal end. A first end of the storage capacitor is electrically connected to the first node, and a second end of the storage capacitor is electrically connected to a second node. A first end of the driving transistor is electrically connected to the first power source voltage end, a second end of the driving transistor is electrically connected to a third node, and a control end of the driving transistor is electrically connected to the second node. A first end of the first switch unit is electrically connected to the second node, a second end of the first switch unit is electrically connected to the third node, and a control end of the first switch unit is electrically connected to a third control signal end. A first end of the second switch unit is electrically connected to the third node, a second end of the second switch unit is electrically connected to a fourth node, and a control end of the second switch unit is electrically connected to a fourth control signal end. The reset module is electrically connected to a reset signal line, a fifth control signal end and the fourth node, and used for transmitting a signal of the reset signal line to the fourth node in response to an enable signal of the fifth control signal end. An anode of the light emitting element is electrically connected to the fourth node, and a cathode of the light emitting element is electrically connected to a second power source voltage end.

In a second aspect, the present disclosure provides a display panel including the pixel driving circuit described as above.

In a third aspect, the present disclosure provides a control method for a pixel driving circuit, for controlling the pixel driving circuit as described above, including: providing a non-enable signal to the first control signal end and providing an enable signal to the second control signal end, the third control signal end, the fourth control signal end and the fifth control signal end in a first stage, so that the signal of the first power source voltage end is transmitted to the first node and the signal of the reset signal line is transmitted to the fourth node, the third node and the second node; providing a non-enable signal to the second control signal end and the fourth control signal end and providing an enable signal to the first control signal end, the third control signal end and the fifth control signal end in a second stage, so that the signal of the data signal end is transmitted to the first node, a threshold compensation is performed to the second node by the first power source voltage end, and the signal of the reset signal line is transmitted to the fourth node; providing a non-enable signal to the first control signal end, the third control signal end and the fifth control signal end and providing an enable signal to the second control signal end and the fourth control signal end in a third stage, so that the signal of the first power source voltage end is transmitted to the first node and a conduction path between the first power source voltage end and the second power source voltage end is formed.

BRIEF DESCRIPTION OF DRAWINGS

In order to more clearly illustrate the embodiments of the present disclosure or technical solutions of the conventional art, the accompanying drawings used in embodiments or description for the conventional art will be briefly described as below. Apparently, drawings in the following description are a part of embodiments of the present disclosure, and those of ordinary skill in the art, without having to pay creative labor, can also obtain other accompanying drawings according to these accompanying drawings.

DESCRIPTION OF EMBODIMENTS

To make the purpose and advantage of the embodiments of the present disclosure clearer, technical solutions in the embodiments of the present disclosure are fully described with reference to the accompanying drawings. It should be understood that, described embodiments are a part of embodiments of the present disclosure, rather than all the embodiments. Based on the embodiments in the present disclosure, the every other embodiment obtained by those of ordinary skill in the art without creative work belongs to the protection scope of the present disclosure.

The term used in the embodiments of the present disclosure is merely used for describing specific embodiment, and is not intended to be limit the present disclosure. Expressions "a", "an" and "the" of a singular form used in the embodiments of the present disclosure and appended claims are also intended to include the plural form thereof, unless otherwise noted.

Figure 1:
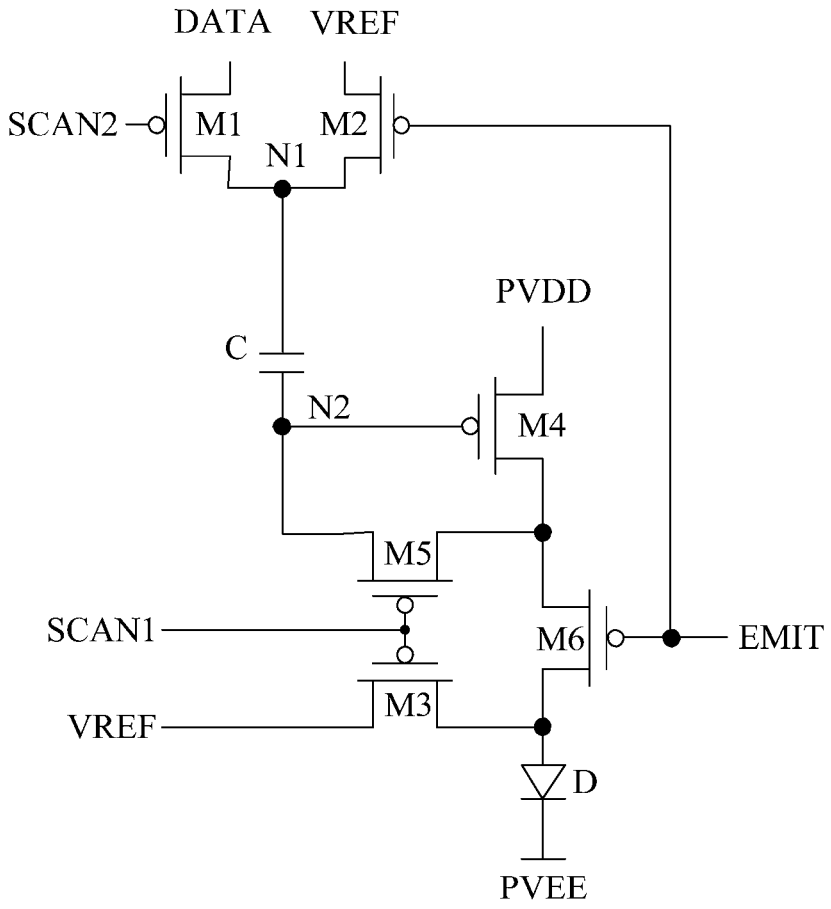
FIG. 1 illustrates a schematic diagram of a pixel driving circuit in the conventional art.
Figure 2:
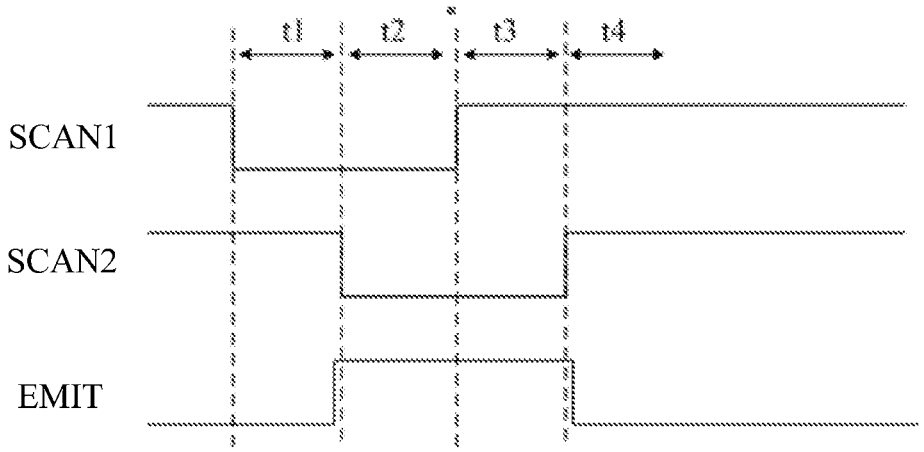
FIG. 2 illustrates a sequence signal diagram of the pixel driving circuit in FIG. 1.

FIG. 1 illustrates a schematic diagram of a pixel driving circuit in the conventional art, and FIG. 2 illustrates a sequence signal diagram of the pixel driving circuit in FIG. 1. As shown in FIGS. 1 and 2, the pixel driving circuit includes a first transistor M1, a second transistor M2, a third transistor M3, a fourth transistor M4, a fifth transistor M5, a sixth transistor M6, a storage capacitor C, a first scan end SCAN1, a second scan end SCAN2, an emitting control end EMIT, a data signal line DATA, a reset signal line VREF, a first power source voltage end PVDD, and a second power source voltage end PVEE. The fourth transistor M4 is a driving transistor. When working, the pixel driving circuit has four stages. At a first stage t1, the reset signal line VREF outputs a reset voltage to nodes N1, N2, and simultaneously outputs a reset voltage to an anode of a light-emitting element D for initializing the light-emitting element D; in a second stage t2, a threshold compensation is performed to the node N2 by the transistors M4, M5, and simultaneously a data signal voltage is transmitted to the node N1 by the data signal line DATA; in a third stage t3, a data signal of the data signal line DATA is transmitted to the node N1 to perform data writing; at a fourth stage t4, the reset signal line VREF outputs a reset voltage to the node N1 to change a potential of the node N1, simultaneously a potential of the node N2 is changed by a coupling effect of the storage capacitor, a variation of the potential of the node N2 being related to the data signal voltage and the reset voltage, and the light-emitting element D is driven to emit light. Since all pixels of the display panel use the same reset signal line VREF to transmit the reset voltage, the pixels of the display panel are scanned row-by-row for data writing, for example, when the pixels of an $n^{th}$ row are scanned to make the pixels of the $n^{th}$ row enter into the first stage t1, other rows except the $n^{th}$ row are non-scan rows, pixels of the non-scan rows are in the fourth stage t4, and in the pixel driving circuit corresponding to the pixels of the $n^{th}$ row, the reset signal line VREF is in communication with the node N2, so that a current on the reset signal line VREF adjacent to the pixels of the $n^{th}$ row is changed and a voltage value on the reset signal line VREF adjacent to the pixels of the $n^{th}$ row changes accordingly; while in the pixel driving circuit corresponding to the pixels of the non-scan rows, the reset signal line VREF is in communication with the node N1, a voltage change on the reset signal line VREF adjacent to the pixels of the $n^{th}$ row makes a potential of the node N2 in the pixel driving circuit corresponding to pixels adjacent to the pixels of the $n^{th}$ row change by the coupling effect of the storage capacitor C. Thus, a problem of non-uniform display is caused.

Figure 3:
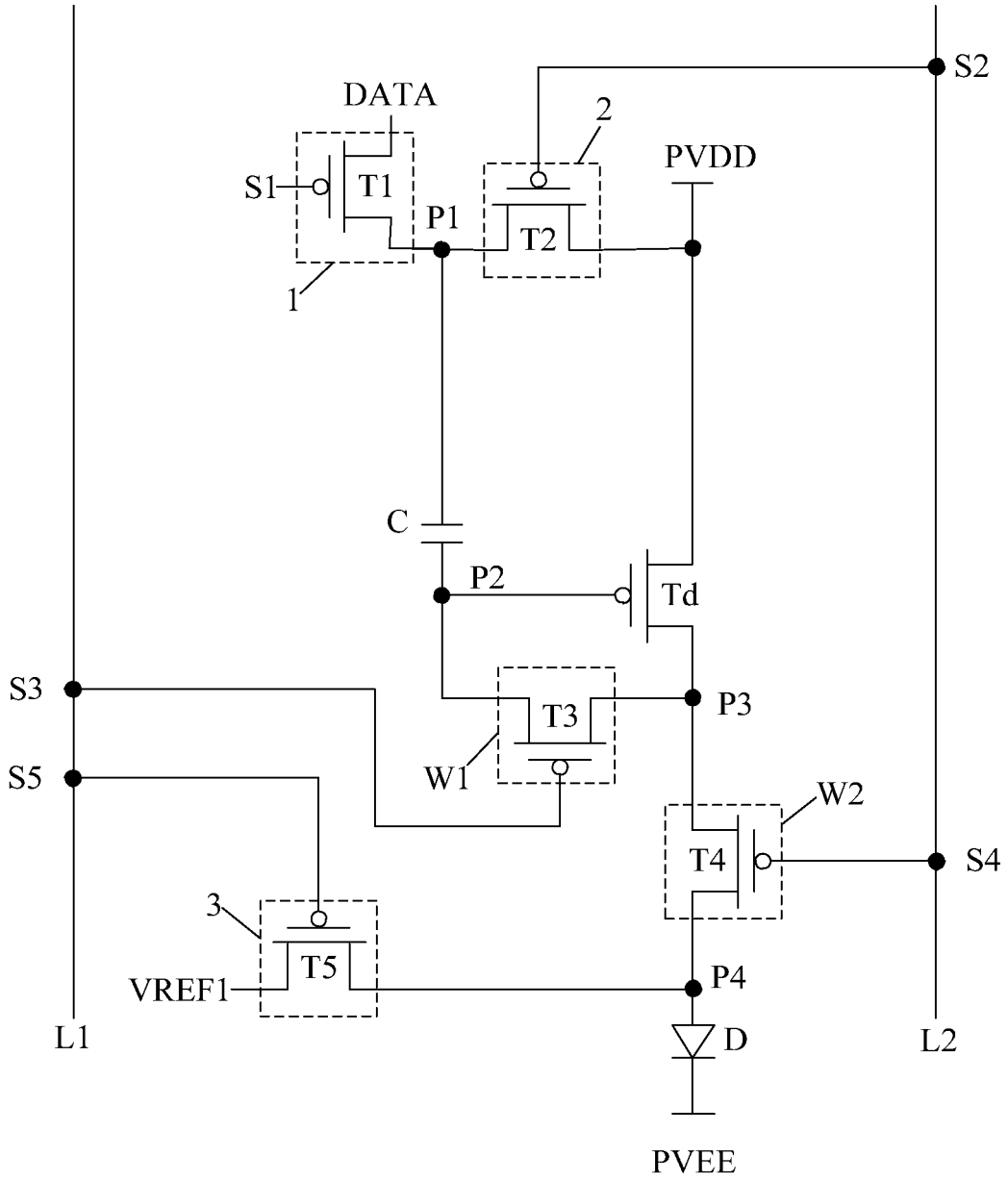
FIG. 3 illustrates a schematic diagram of a pixel driving circuit in an embodiment of the present disclosure.

As shown in FIG. 3, which illustrates a schematic diagram of a pixel driving circuit in an embodiment of the present disclosure, the pixel driving circuit includes a data writing module 1 electrically connected to a data signal end DATA, a first control signal end S1 and a first node P1, and used for transmitting a signal of the data signal end DATA to the first node P1 in response to an enable signal of the first control signal end S1; a coupling writing module 2 electrically connected to a first power source voltage end PVDD, a second control signal end S2 and the first node P1, and used for transmitting a signal of the first power source voltage end PVDD to the first node P1 in response to an enable signal of the second control signal end S2; a storage capacitor C, a first end of the storage capacitor C being electrically connected to the first node P1, a second end of the storage capacitor C being electrically connected to a second node P2; a driving transistor Td, a first end of the driving transistor Td being electrically connected to the first power source voltage end PVDD, a second end of the driving transistor Td being electrically connected to a third node P3, a control end of the driving transistor Td being electrically connected to the second node P2; a first switch unit W1, a first end of the first switch unit W1 being electrically connected to the second node P2, a second end of the first switch unit W1 being electrically connected to the third node P3, a control end of the first switch unit W1 being electrically connected to a third control signal end S3; a second switch unit W2, a first end of the second switch unit W2 being electrically connected to the third node P3, a second end of the second switch unit W2 being connected to a fourth node P4, a control end of the second switch unit W2 being electrically connected to a fourth control signal end S4; a reset module 3 electrically connected to a reset signal line VREF1, a fifth control signal end S5 and the fourth node P4, and used for transmitting a signal of the reset signal line VREF1 to the fourth node P4 in response to an enable signal of the fifth control signal end S5; and a light emitting element D, an anode of the light emitting element D being electrically connected to the fourth node P4, an cathode of light emitting element D being electrically connected to a second power source voltage end PVEE.

Figure 4:
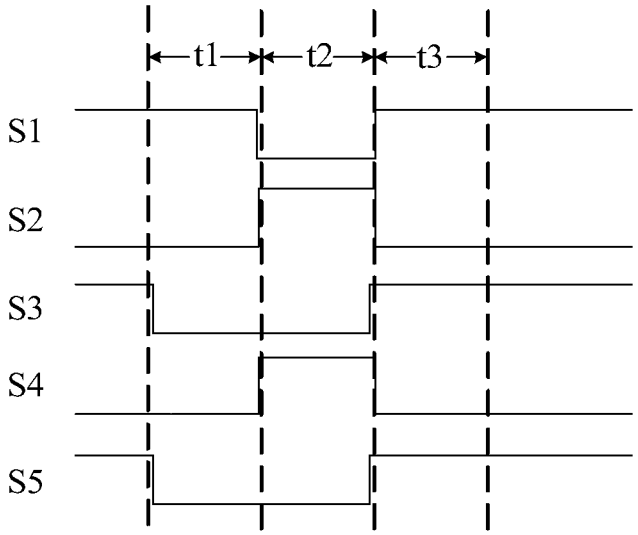
FIG. 4 illustrates a sequence signal diagram of the pixel driving circuit in FIG. 3.

As shown in FIG. 4, which illustrates a sequence signal diagram of the pixel driving circuit in FIG. 3, an embodiment of the present disclosure further provides a control method for a pixel driving circuit, used for the pixel driving circuit as shown in FIG. 3. The control method for a pixel driving circuit includes: in a first stage t1, proving a non-enable signal to the first control signal end S1, and providing an enable signal to the second control signal end S2, the third control signal end S3, the fourth control signal end S4, and the fifth control signal end S5, so that a signal of the first power source voltage end PVDD is transmitted to the first node P1 and a signal of the reset signal line VREF1 is transmitted to the fourth node P4, the third node P3 and the second node P2; assuming that the first power source voltage end PVDD outputs a constant first power source voltage Vdd, and the reset signal line VREF1 outputs a constant reset voltage Vref1, then in the first stage t1, a potential of the first node P1 is Vdd, a potential of the second node P2 is Vref1, and the anode of the light emitting element D is initiated by the reset voltage Vref1; in a second stage t2, providing a non-enable signal to the second control signal end S2 and the fourth control signal end S4, and providing an enable signal to the first control signal end S1, the third control signal end S3 and the fifth control signal end S5, so that the signal of the data signal end DATA is transmitted to the first node P1, a potential of the first node P1 is changed to be Vdata, Vdata being a data voltage provided by the data signal end DATA, the driving transistor Td is turned on, a threshold compensation is performed to the node N2 by the first power source voltage end PVDD, i.e., the first power source voltage end PVDD is in communication with the second node P2 by the driving transistor Td and the first switch unit W1, until the potential of the second node P2 is changed to be Vdd−|Vth|, the driving transistor Td is changed to be in a turn-off state, Vth being a threshold voltage of the driving transistor Td, and a signal of the reset signal line VREF1 is transmitted to the fourth node P4; in a third stage t3, providing a non-enable signal to the first control signal end S1, the third control signal end S3 and the fifth control signal end S5, and providing an enable signal to the second control signal end S2 and the fourth control signal end S4, so that a signal of the first power source voltage end PVDD is transmitted to the first node P1, at this time, the potential of the first node P1 is changed to be Vdd from Vdata, i.e., the potential of the first node P1 is increased by Vdd-Vdata, and as a function of the storage capacitor C, the potential of the second node P2 increases from Vdd−|Vth| to Vdd−|Vth|+Vdd−Vdata, meanwhile the second switch unit W2 is turned on, and further as Vth<0, Vdd<Vdata and a gate potential of the driving transistor Td is lower than a source potential of the driving transistor Td, the driving transistor Td is turned on, and a conduction path is formed between the first power source voltage end PVDD and the second power source voltage end PVEE, and a driving current of the driving transistor Td is Id, $Id=k(Vsg-|Vth|)^2=k[Vdd-(Vdd-|Vth|+Vdd-Vdata)-|Vth|]^2=k(Vdata-Vdd)^2$, and k is a constant and Vsg is the gate-source voltage of the driving transistor Td. It can be known that, in the final driving current equation, an influence of the threshold voltage Vth is eliminated, and thus the light emitting element D can be driven to emit light by the driving current Id. In the third stage t3, only the first power source voltage end PVDD is in communication with the first node P1, and the voltage value output from the first power source voltage end PVDD keeps constant, so that the potential of the first node P1 is not affected.

In the pixel driving circuit and the driving method therefore in the embodiments of the present disclosure, when scanning the pixels of a $n^{th}$ row to make the pixels of the $n^{th}$ line enter into the first stage, other rows except the $n^{th}$ row are non-scan rows, pixels of the non-scan rows are in the third stage, and in a pixel driving circuit corresponding to the non-scan rows, the first node is not in communication with the reset signal line, therefore, even though the voltage value on the reset signal line is changed, the voltage value of the first node in the pixel circuit corresponding to other pixels won't be changed, that is, the voltage value of the second node won't be affected, and the brightness of the light emitting element won't be changed, thereby alleviating the problem of non-uniform display.

It should be noted that, as shown in FIG. 4, a signal sequence of the third control signal end S3 and a signal sequence of the fifth control signal end S5 are identical, so that a same signal line can be used to provide signal for the third control signal end S3 and the fifth control signal end S5; and a signal sequence of the second control signal end S2 and a signal sequence of the fourth control signal end S4 are identical, so that a same signal line can be used to provide signal for the second control signal end S2 and the fourth control signal end S4. As shown in FIG. 3, the pixel driving circuit further includes a first signal line L1 and a second signal line L2, the second control signal end S2 and the fourth control signal end S4 are placed on the first signal line L1, and the third control signal end S3 and the fifth control signal end S5 are placed on the second signal line L2.

Optionally, as shown in FIG. 3, the data writing module 1 includes a first switch transistor T1. A first end of the first switch transistor T1 is electrically connected to the data signal end DATA, a second end of the first switch transistor T1 is electrically connected to the first node P1, and a control end of the first switch transistor T1 is electrically connected to the first control signal end S1. The coupling writing module 2 includes a second switch transistor T2. A first end of the second switch transistor T2 is electrically connected to the first power source voltage end PVDD, a second end of the second switch transistor T2 is electrically connected to the first node P1, and a control end of the second switch transistor T2 is electrically connected to the second control signal end S2. The first switch unit W1 includes a third switch transistor T3. A first end of the third switch transistor T3 is electrically connected to the second node P2, a second end of the third switch transistor T3 is electrically connected to the third node P3, and a control end of the third switch transistor T3 is electrically connected to the third control signal end S3. The second switch unit W2 includes a fourth switch transistor T4. A first end of the fourth switch transistor T4 is electrically connected to the third node P3, a second end of the fourth switch transistor T4 is electrically connected to the fourth node P4, and a control end of the fourth switch transistor T4 is electrically connected to the fourth control signal end S4. The reset module 3 includes a fifth switch transistor T5. A first end of the fifth switch transistor T5 is electrically connected to the reset signal line VREF1, a second end of the fifth switch transistor T5 is electrically connected to the fourth node P4, and a control end of the fifth switch transistor T5 is electrically connected to the fifth control signal end S5.

In the first stage t1, the first control signal end S1 is provided with the non-enable signal so that the first switch transistor T1 is turned off, the second control signal end S2, the third control signal end S3, the fourth control signal end S4 and the fifth control signal end S5 are provided with the enable signal so that the second switch transistor T2, the third switch transistor T3, the fourth switch transistor T4 and the fifth switch transistor T5 are turned on, the signal of the first power source voltage end PVDD is transmitted to the first node P1 by the second switch transistor T2, and the signal of the reset signal line VREF1 is transmitted to the fourth node P4 by the fifth switch transistor T5, then to the third node P3 by the fourth switch transistor T4 and to the second node P2 by the third switch transistor T3. Assuming that the first power source voltage end PVDD outputs a constant first power source voltage Vdd and the reset signal line VREF1 outputs a constant reset voltage Vref1, then, in the first stage t1, the potential of the first node P1 is Vdd, the potential of the second node P2 is Vref1, and the anode of the light emitting element D is initiated by the reset voltage Vref1. In the second stage t2, the second control signal end S2 and the fourth control signal end S4 are provided with the non-enable signal so that the second switch transistor T2 and the fourth switch transistor T4 are turned off, and the first control signal end S1, the third control signal end S3 and the fifth control signal end S5 are provided with the enable signal so that the first switch transistor T1, the third switch transistor T3 and the fifth switch transistor T5 are turned on, so that the signal of the data signal end DATA is transmitted to the first node P1 by the first switch transistor T1, at this time the potential of the first node P1 is changed to be Vdata, Vdata being a data voltage provided by the data signal end DATA, the driving transistor Td is turned on, the threshold compensation is performed to the second node P2 by the first power source voltage end PVDD, that is, the first power source voltage end PVDD is in communication with the second node P2 by the driving transistor Td and the third switch transistor T3, until the potential of the second node P2 is changed to be Vdd−|Vth|, the driving transistor Td is turned off, Vth being a threshold voltage of the driving transistor Td, and the signal of the reset signal line VREF1 is transmitted to the fourth node P4 by the fifth switch transistor T5. In the third stage t3, the first control signal end S1, the third control signal end S3 and the fifth control signal end S5 are provided with the non-enable signal so that the first switch transistor T1, the third switch transistor T3 and the fifth switch transistor T5 are turned off, the second control signal end S2 and the fourth control signal end S4 are provided with the enable signal so that the second switch transistor T2 and the fourth switch transistor T4 are turned on, so that the signal of the first power source voltage end PVDD is transmitted to the first node P1 by the second switch transistor T2, at this time, the potential of the first node P1 is changed from Vdata to Vdd, and is increased by Vdd-Vdata, and as a function of the storage capacitor C, the potential of the second node P2 increases from Vdd−|Vth| to Vdd−|Vth|+Vdd−Vdata, meanwhile the fourth switch transistor T4 is turned on and the driving transistor Td is turned on, so that a conduction path is formed between the first power source voltage end PVDD and the second power source voltage end PVEE, the driving current of the driving transistor Td is Id, $Id=k(Vsg-|Vth|)^2=k[Vdd-(Vdd-|Vth|+Vdd-Vdata)-|Vth|]^2=k(Vdata-Vdd)^2$, and k is a constant and Vsg is the gate-source voltage of the driving transistor Td. It can be known that, in a final driving current equation, an influence of the threshold voltage Vth is eliminated, thus, the light emitting element D can be driven to emit light by the driving current Id. In the third stage t3, only the first power source voltage end PVDD is in communication with the first node P1, and the voltage value output by the first power source voltage end PVDD keeps constant, so that the potential of the first node P1 won't be affected. Even if the voltage value on the reset signal line VREF1 is changed, the voltage value of the first node P1 in the driving circuit corresponding to other pixels may not be changed, i.e., the voltage value of the second node P2 won't be affected, so that the brightness of the light emitting element won't be changed, thereby alleviating the problem of non-uniform display.

Figure 5:
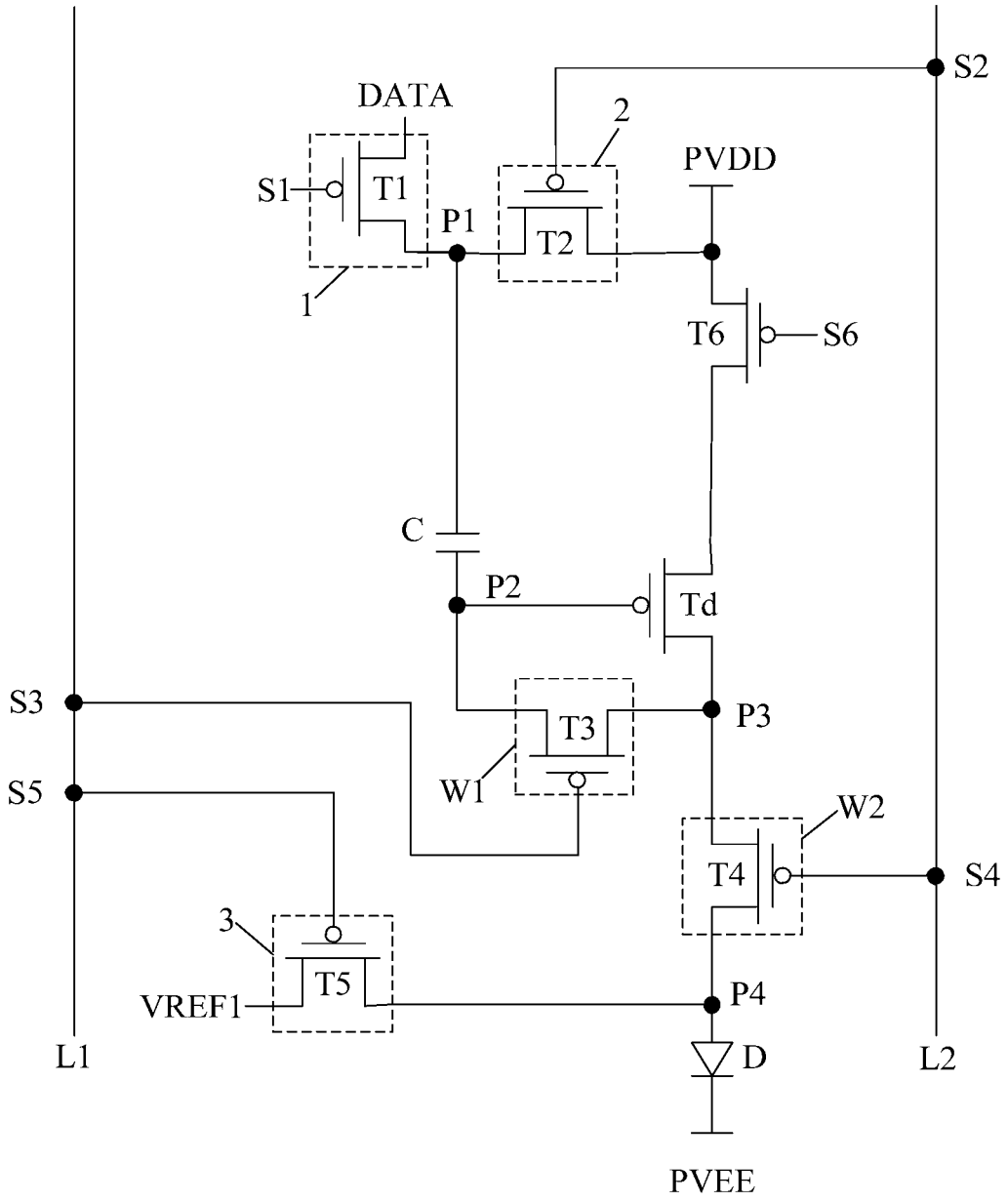
FIG. 5 illustrates a schematic diagram of a pixel driving circuit in another embodiment of the present disclosure.

Optionally, as shown in FIG. 5, which illustrates a schematic diagram of a pixel driving circuit in another embodiment of the present disclosure, the pixel driving circuit further includes a sixth switch transistor T6. The first end of the driving transistor Td is electrically connected to the first power source voltage end PVDD by the sixth switch transistor T6. A first end of the sixth switch transistor T6 is electrically connected to the first power source voltage end PVDD, a second end of the sixth switch transistor T6 is electrically connected to the first end of the driving transistor Td, and a control end of the sixth switch transistor T6 is electrically connected to the sixth control signal end S6.

Figure 6:
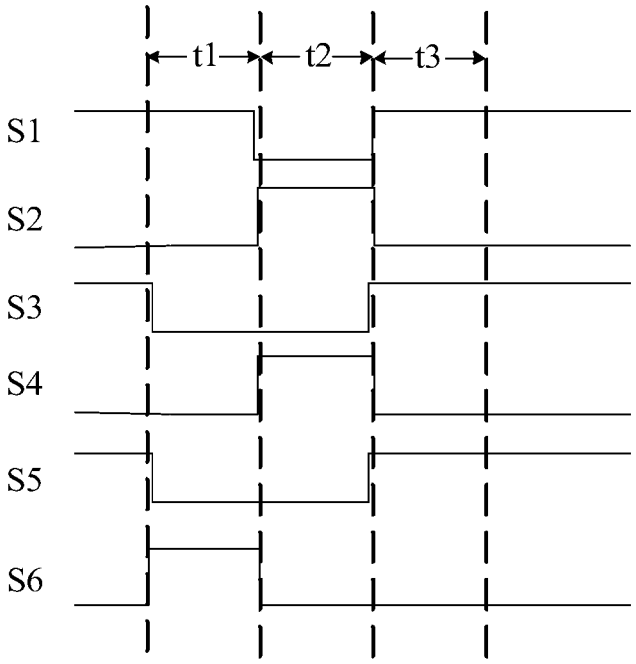
FIG. 6 illustrates a sequence signal diagram of the pixel driving circuit in FIG. 5.

As shown in FIG. 6, which illustrates a sequence signal diagram of the pixel driving circuit in FIG. 5, one embodiment of the present disclosure further provides a control method for a pixel driving circuit, used for the pixel driving circuit as shown in FIG. 5. The control method for a pixel driving circuit includes: in a first stage t1, a non-enable signal is provided to the first control signal end S1 and the sixth control signal end S6 so that the first switch transistor T1 and the sixth switch transistor T6 are turned off, and an enable signal is provided to the second control signal end S2, the third control signal end S3, the fourth control signal end S4 and the fifth control signal end S5 so that the second switch transistor T2, the third switch transistor T3, the fourth switch transistor T4 and the fifth switch transistor T5 are turned on, so as to transmit a signal of the first power source voltage end PVDD to the first node P1 by the second switch transistor T2 and transmit a signal of the reset signal line VREF1 to the fourth node P4 by the fifth switch transistor T5, then to the third node P3 by the fourth switch transistor T4 and to the second node P2 by the third switch transistor T3; assuming that the first power source voltage end PVDD outputs a constant first power source voltage Vdd and the reset signal line VREF1 outputs a constant reset voltage Vref1, then in the first stage t1, a potential of the first node P1 is Vdd, a potential of the second node P2 is Vref1, and the anode of the light emitting element D is initiated by the reset voltage Vref1, and that the sixth switch transistor T6 is turned off can prevent an influence of the first power source voltage Vdd on the initiation process of the light emitting element D, thereby improving the display effect; in a second stage t2, a non-enable signal is provided to the second control signal end S2 and the fourth control signal end S4 so that the second switch transistor T2 and the fourth switch transistor T4 are turned off, and an enable signal is provided to the first control signal end S1, the third control signal end S3, the fifth control signal end S5 and the sixth control signal end S6 so that the first switch transistor T1, the third switch transistor T3, the fifth switch transistor T5 and the sixth switch transistor T6 are turned on, so that the signal of the data signal end DATA is transmitted to the first node P1 by the first switch transistor T1, at this time the potential of the first node P1 is changed to be Vdata, Vdata being a data voltage provided by the data signal end DATA, the driving transistor Td is turned on, a threshold compensation is performed to the second node P2 by the first power source voltage end PVDD, that is, the first power source voltage end PVDD is in communication with the second node P2 by the sixth switch transistor T6, the driving transistor Td and the third switch transistor T3, until the potential of the second node P2 is changed to be Vdd−|Vth|, the driving transistor Td is changed to be in a turn-off state, Vth being a threshold voltage of the driving transistor Td, and a signal of the reset signal line VREF1 is transmitted to the fourth node P4 by the fifth switch transistor T5; in a third stage t3, a non-enable signal is provided to the first control signal end S1, the third control signal end S3 and the fifth control signal end S5 so that the first switch transistor T1, the third switch transistor T3 and the fifth switch transistor T5 are turned off, and an enable signal is provided to the second control signal end S2, the fourth control signal end S4 and the sixth control signal end S6 so that the second switch transistor T2, the fourth switch transistor T4 and the sixth switch transistor T6 are turned on, so that a signal of the first power source voltage end PVDD is transmitted to the first node P1 by the second switch transistor T2, at this time, the potential of the first node P1 is changed to be Vdd from Vdata, that is, the potential of the first node P1 is increased by Vdd−Vdata, and as a function of the storage capacitor C, the potential of the second node P2 increases from Vdd−|Vth| to Vdd−|Vth|+Vdd−Vdata, meanwhile the fourth switch transistor T4, the sixth switch transistor T6 and the driving transistor Td are turned on, a conduction path is formed between the first power source voltage end PVDD and the second power source voltage end PVEE, and a driving current of the driving transistor Td is Id, $Id=k(Vsg-|Vth|)^2=k[Vdd-(Vdd-|Vth|+Vdd-Vdata)-|Vth|]^2=k(Vdata-Vdd)^2$, and k is a constant and Vsg is the gate-source voltage of the driving transistor Td. It can be known that, in a final driving current equation, an influence of the threshold voltage Vth is eliminated, thus, the light emitting element D can be driven to emit light by the driving current Id. In the third stage t3, only the first power source voltage end PVDD is in communication with the first node P1, and the voltage value output from the first power source voltage end PVDD keeps constant, so that the potential of the first node P1 won't be affected. Even if the voltage value on the reset signal line VREF1 is changed, the voltage value of the first node P1 in the pixel driving circuit corresponding to other pixels won't be changed, that is, the voltage value of the second node P2 won't be affected, so that the brightness of the light emitting element won't be changed, thereby alleviating the problem of non-uniform display. Compared with the structure shown in FIG. 3, in the structure shown in FIG. 5, the sixth switch transistor T6 is further provided, so that in the first stage t1, and the signal of the first power source voltage end PVDD won't affect the driving transistor Td, therefore, in the first stage t1, the potential of the first node P1 is reset to be Vdd, the potential of the second node P2 is reset to be Vref1, and the potentials of the first node P1 and the second node P2 won't affect each other.

It should be noted that, as shown in FIG. 6, a signal sequence of the third control signal end S3 and a signal sequence of the fifth control signal end S5 are identical, so that a same signal line can be used to provide signal for the third control signal end S3 and the fifth control signal end S5; a signal sequence of the second control signal end S2 and a signal sequence of the fourth control signal end S4 are identical, so that a same signal line can be used to provide signal for the second control signal end S2 and the fourth control signal end S4. As shown in FIG. 5, the pixel driving circuit further includes a first signal line L1 and a second signal line L2, the second control signal end S2 and the fourth control signal end S4 are placed on the first signal line L1, and the third control signal end S3 and the fifth control signal end S5 are placed on the second signal line L2.

Figure 7:
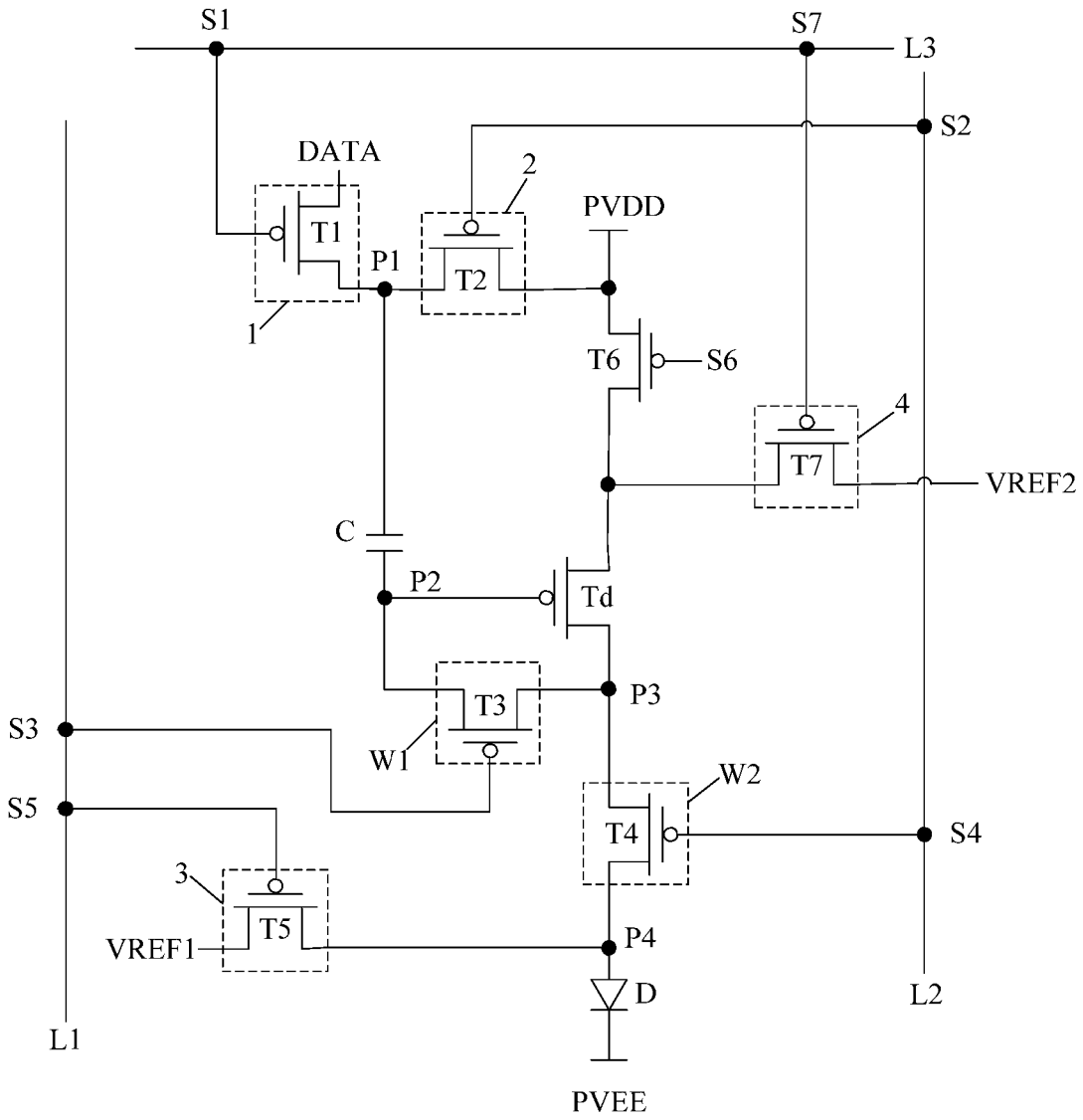
FIG. 7 illustrates a schematic diagram of a pixel driving circuit in still another embodiment of the present disclosure.

Optionally, as shown in FIG. 7, which illustrates a schematic diagram of a pixel driving circuit in still another embodiment of the present disclosure, the pixel driving circuit further includes a compensation module 4 electrically connected to a reference voltage signal end VREF2, a seventh control signal end S7 and the first end of the driving transistor Td and used for transmitting a signal of the reference voltage signal end VREF2 to the first end of the driving transistor Td in response to an enable signal of the seventh control signal end S7.

Figure 8:
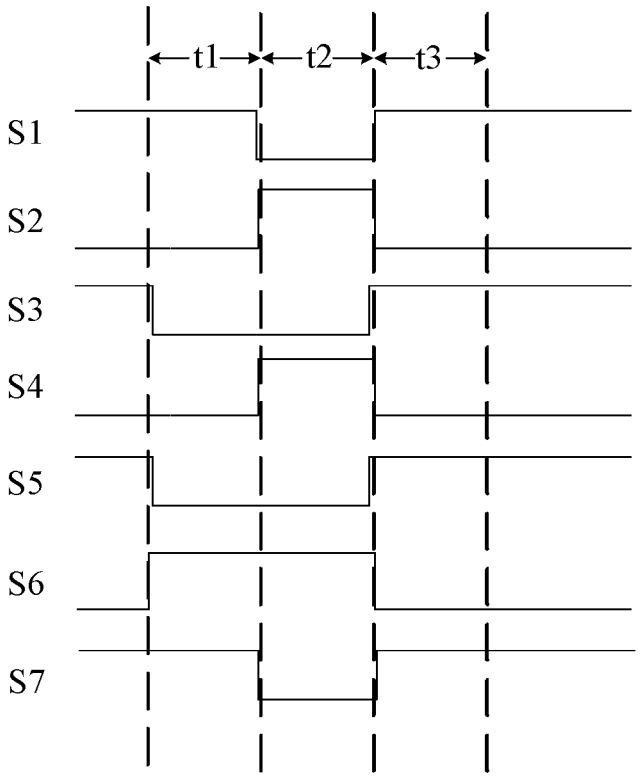
FIG. 8 illustrates a sequence signal diagram of the pixel driving circuit in FIG. 7.

As shown in FIG. 8, which illustrates a sequence signal diagram of the pixel driving circuit in FIG. 7, an embodiment of the present disclosure further provides a control method for a pixel driving circuit, used for the pixel driving circuit as shown in FIG. 7. The control method for a pixel driving circuit includes: in a first stage t1, a non-enable signal is provided to the first control signal end S1, the sixth control signal end S6 and the seventh control signal end S7 so that the first switch transistor T1, the sixth switch transistor T6 and the compensation module 4 are turned off, and an enable signal is provided to the second control signal end S2, the third control signal end S3, the fourth control signal end S4 and the fifth control signal end S5 so that the second switch transistor T2, the third switch transistor T3, the fourth switch transistor T4 and the fifth switch transistor T5 are turned on, so as to transmit a signal of the first power source voltage end PVDD to the first node P1 by the second switch transistor T2 and transmit a signal of the reset signal line VREF1 to the fourth node P4 by the fifth switch transistor T5, then to the third node P3 by the fourth switch transistor T4 and to the second node P2 by the third switch transistor T3; assuming that the first power source voltage end PVDD outputs a constant first power source voltage Vdd and the reset signal line VREF1 outputs a constant reset voltage Vref1, then in the first stage t1, a potential of the first node P1 is Vdd, a potential of the second node P2 is Vref1, the anode of the light emitting element D is initiated by the reset voltage Vref1, and that the sixth switch transistor T6 is turned off can prevent an influence of the first power source voltage Vdd on the initiation process of the light emitting element D, thereby further improving the display effect; in a second stage t2, a non-enable signal is provided to the second control signal end S2, the fourth control signal end S4 and the sixth control signal end S6 so that the second switch transistor T2, the fourth switch transistor T4 and the sixth switch transistor T6 are turned off, and an enable signal is provided to the first control signal end S1, the third control signal end S3, the fifth control signal end S5 and the seventh control signal end S7 so that the first switch transistor T1, the third switch transistor T3, the fifth switch transistor T5 and the compensation module 4 are turned on, so as to transmit the signal of the data signal end DATA to the first node P1 by the first switch transistor T1, meanwhile change the potential of the first node P1 to be Vdata, Vdata being a data voltage provided by the data signal end DATA, turn on the driving transistor Td, perform a threshold compensation to the second node P2 by the reference voltage signal end VREF2, that is, the reference voltage signal end VREF2 is in communication with the second node P2 by the compensation module 4, the driving transistor Td and the third switch transistor T3, until the potential of the second node P2 is changed to be Vref2−|Vth|, the driving transistor Td is changed to be in a turn-off state, Vth being a threshold voltage of the driving transistor Td, Vref2 being a constant voltage provided by the reference voltage signal end VREF2, and a signal of the reset signal line VREF1 is transmitted to the fourth node P4 by the fifth switch transistor T5; in a third stage t3, a non-enable signal is provided to the first control signal end S1, the third control signal end S3, the fifth control signal end S5 and the sixth control signal end S6 so that the first switch transistor T1, the third switch transistor T3, the fifth switch transistor T5 and the compensation module 4 are turned off, and an enable signal is provided to the second control signal end S2, the fourth control signal end S4 and the sixth control signal end S6 so that the second switch transistor T2, the fourth switch transistor T4 and the sixth switch transistor T6 are turned on, so that a signal of the first power source voltage end PVDD is transmitted to the first node P1 by the second switch transistor T2, meanwhile the potential of the first node P1 is changed from Vdata to Vdd, i.e., the potential of the first node P1 is increased by Vdd−Vdata, and as a function of the storage capacitor C, the potential of the second node P2 increases from Vref2−|Vth| to Vref2−|Vth|+Vdd−Vdata, meanwhile the fourth switch transistor T4, the sixth switch transistor T6 and the driving transistor Td are turned on, a conduction path is formed between the first power source voltage end PVDD and the second power source voltage end PVEE, a driving current of the driving transistor Td is Id, and the light emitting element D can be driven to emit light by the driving current Id, $Id=k(Vsg-|Vth|)^2=k[Vdd-(Vref2-|Vth|+Vdd-Vdata)-|Vth|]^2=k(Vdata-Vref2)^2$, and k is a constant and Vsg is the gate-source voltage of the driving transistor Td. It's can be known that, in a final driving current equation, not only the threshold voltage Vth is eliminated, but also the first power source voltage Vdd is eliminated. In the structure shown in FIG. 3 or FIG. 5, since the first power source voltage end PVDD is further used for providing a great current, the first power source voltage ends PVDD at different positions in the whole display panel have different voltage values Vdd due to current consumption, which may result in a problem of non-uniform display. In the structure as shown in FIG. 7, the reference voltage signal end VREF2 is only used for providing a reference voltage value included in the gate voltage of the driving transistor Td and thus is not needed to provide a great current, so that different voltage values caused by current consumption won't occur, and the problem of non-uniform display caused by difference of Vdd is alleviated. Similarly, in the third stage t3, only the reference voltage signal end VREF2 is in communication with the first node P1, and the voltage value output from the reference voltage signal end VREF2 keeps constant, so that the potential of the first node P1 is not affected. Even if the voltage value on the reset signal line VREF1 is changed, the voltage value of the first node P1 in the pixel driving circuit corresponding to other pixels won't be changed, that is, the voltage value of the second node P2 won't be affected, and the brightness of the light emitting element won't be changed, so that the problem of non-uniform display is alleviated.

Optionally, as shown in FIG. 7, the compensation module 4 includes a seventh switch transistor T7. A first end of the seventh switch transistor T7 is electrically connected to the reference voltage signal end VREF2, a second end of the seventh switch transistor T7 is electrically connected to the first end of the driving transistor Td, and a control end of the seventh switch transistor T7 is electrically connected to the seventh control signal end S7.

A function of the compensation module 4 can be realized by the seventh switch transistor T7. A control method of the compensation module 4 is the same as a method corresponding to the sequence signal diagram shown in FIG. 8, which is not repeated herein.

It should be noted that, all of the each switch transistors and the driving transistors Td shown in FIGS. 3, 5 and 7 are P-type transistors, but control types of the switch transistors and the driving transistors are not limited in the present disclosure. For example, at least one or any combination of the switch transistors and the driving transistors can be N-type transistor. In addition, the type of a signal provided by the control signal end connected to the control end of the respective switch transistor is related to the control type of the switch transistor. For example, when the first switch transistor T1 is a P-type transistor, the enable signal provided by the first control signal end S1 is a low level, and the non-enable signal provided by the first control signal end S1 is a high level; and when the first switch transistor T1 is a N-type transistor, the enable signal provided by the first control signal end S1 is a high level, and the non-enable signal provided by the first control signal end S1 is a low level.

Optionally, as shown in FIG. 7, the first switch transistor T1, the second switch transistor T2, the third switch transistor T3, the fourth switch transistor T4, the fifth switch transistor T5, the sixth switch transistor T6 and the seventh switch transistor T7 are all P-type transistors.

For example, in a current display panel, all the switch transistors are P-type transistors, which is easier to realize in a making process.

It should be noted that, as shown in FIG. 8, a signal sequence of the third control signal end S3 and a signal sequence of the fifth control signal end S5 are identical, so that a same signal line can be used to provide signal for the third control signal end S3 and the fifth control signal end S5; a signal sequence of the second control signal end S2 and a signal sequence of the fourth control signal end S4 are identical, so that a same signal line can be used to provide signal for the second control signal end S2 and the fourth control signal end S4; and a signal sequence of the first control signal end S1 and a signal sequence of the seventh control signal end S7 are identical, so that a same signal line can be used to provide signal for the first control signal end S1 and the seventh control signal end S7. As shown in FIG. 7, the pixel driving circuit further includes a first signal line L1, a second signal line L2 and a third signal line L3, the second control signal end S2 and the fourth control signal end S4 are placed on the first signal line L1, the third control signal end S3 and the fifth control signal end S5 are placed on the second signal line L2, and the first control signal end S1 and the seventh control signal end S7 are placed on the second signal line L3.

Optionally, the light emitting element D is an organic light-emitting diode.

Optionally, as shown in FIG. 3, FIG. 5, or FIG. 7, the third switch transistor T3 is a multi-gate structure.

The potential of the second node P2 determines the luminous brightness of the light emitting element D, so that the third switch transistor T3 can be multi-gate structure, such as double-gate, triple-gate. Compared with a single-gate structure, a multi-gate transistor can further decrease a leakage current of the third switch transistor T3, so that the potential of the second node P2 won't be changed due to the leakage current of the third switch transistor T3.

Optionally, a Width-Length ratio of a channel of the driving transistor Td is smaller than 1.

The driving transistor Td is different from the switch transistor, and works in a saturation region, this may be effective for the driving effect of the driving transistor Td working in the saturation region when the channel width/length ratio of the driving transistor Td is smaller than 1.

Figure 9:
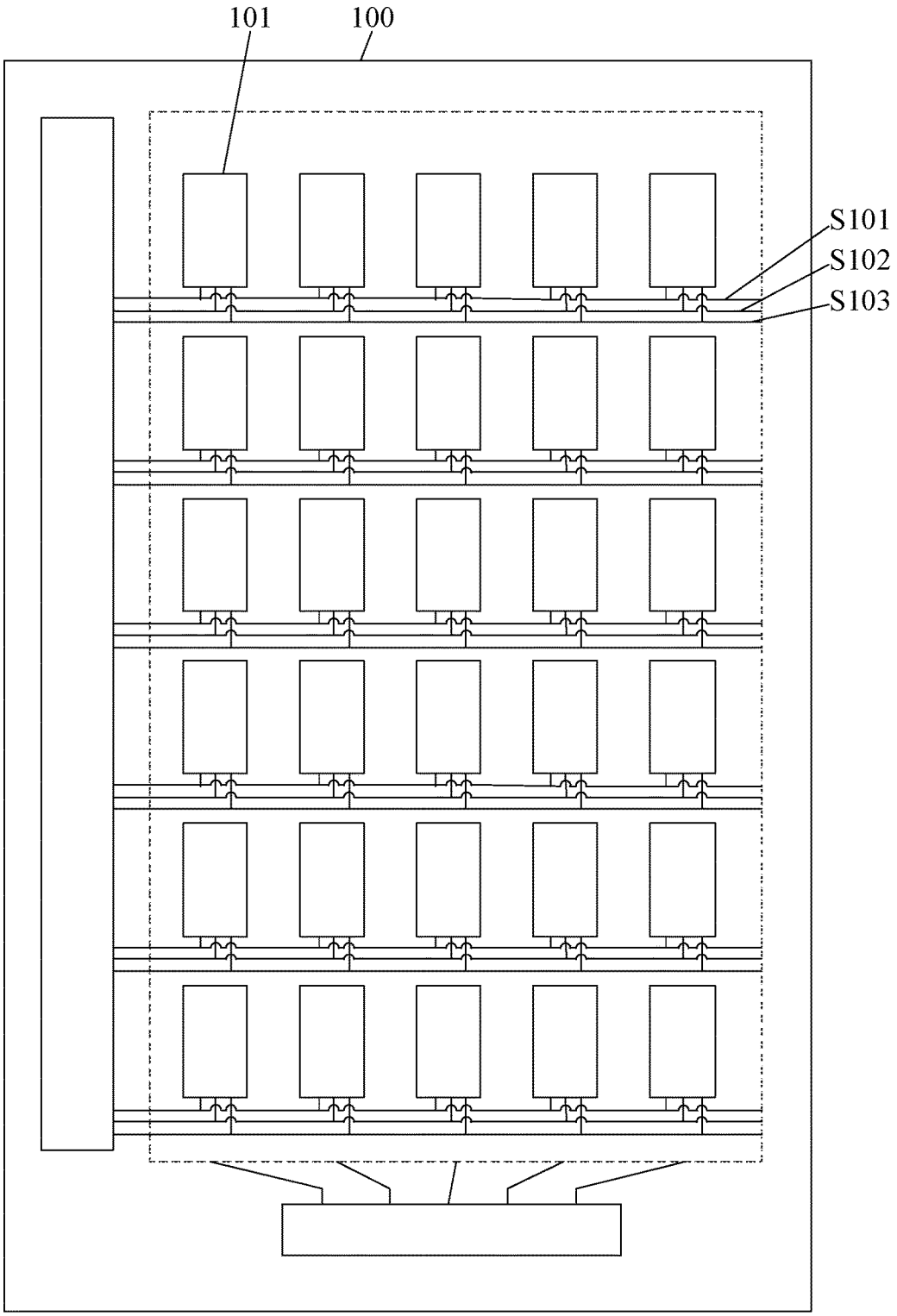
FIG. 9 illustrates a structural schematic diagram of a display panel in an embodiment of the present disclosure.
Figure 10:
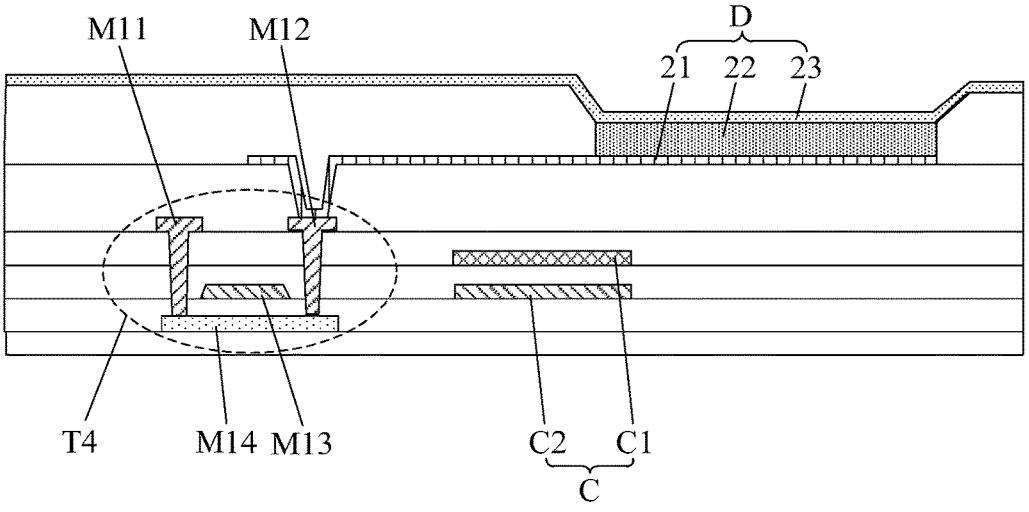
FIG. 10 illustrates a partial, cross-sectional, structural schematic diagram of the display panel in FIG. 9.

FIG. 9 illustrates a structural schematic view of a display panel in an embodiment of the present disclosure; and FIG. 10 illustrates a partial, cross-sectional, structural schematic diagram of the display panel in FIG. 9. As shown in FIGS. 9 and 10, the embodiment of the present disclosure further provides a display panel, including any one of the pixel driving circuits shown in FIGS. 3, 5 and 7.

The display panel includes a plurality of sub-pixels 101 distributed in a matrix. Each sub-pixel corresponds to one pixel driving circuit. In the following, a display panel including the pixel driving circuit as shown in FIG. 3 is taken as an example for illustrating the structure of the display panel. Each row of sub-pixels corresponds to a first scan line S101, a second scan line S102 and a third scan line S103. The first scan line S101 is used for providing a first scan signal control end S1 corresponding to the row of sub-pixels, the second scan line S102 is used for providing a second signal control end S2 and a fourth signal control end S4 corresponding to the row of sub-pixels, and the third scan line S103 is used for providing a third signal control end S3 and a fifth signal control end S5 corresponding to the row of sub-pixels. As shown in FIG. 10, for example, each light emitting element D sequentially includes an anode layer 21, a light emitting layer 22 and a cathode layer 23. Each transistor in the pixel driving circuit includes a source electrode M11, a drain electrode M12, a gate electrode M13, and an active layer M14. The storage capacitor C includes a first electrode plate C1 and a second electrode plate C2. The gate electrode M13 and the second electrode plate C2 are placed in a first metallic layer, the first electrode plate C1 is placed in a second metallic layer, and the source electrode M11 and the drain electrode M12 are placed in a third metallic layer. The third metallic layer, the second metallic layer, the first metallic layer and the active layer M14 are sequentially placed on a side of the anode layer 21 away from the cathode layer 23. That is, the third metallic layer is placed on a side of the anode layer 21 away from the cathode layer 23, the second metallic layer is placed on a side of the third metallic layer away from the cathode layer 23, and the first metallic layer is placed on a side of the second metallic layer away from the cathode layer 23. The drain electrode M12 of the fourth transistor T4 in FIG. 3 is connected to the anode layer 21 through a through hole. In addition, the first signal line L1, the second signal line L2 and the third signal line L3 shown in FIG. 7, can be respectively placed in different film layers, for facilitating wiring. For example, the first signal line L1 is placed in the second metallic layer, the second signal line L2 is placed in the first metallic layer, and the third signal line L3 is placed in the third metallic layer.

It should be noted that, FIG. 9 only shows a structure in which each row of sub-pixels corresponds to three scan lines, and a quantity of the scan lines is related to a specific structure of the corresponding pixel driving circuit. For example, the pixel driving circuit shown in FIG. 3 or 5 corresponds to three scan lines, while the pixel driving circuit shown in FIG. 7 corresponds to four scan lines. Only the fourth transistor T4 and the storage capacitor C in the pixel driving circuit are schematically illustrated in FIG. 10, and layer structures of other transistors can be the same as the structure of the fourth transistor T4. In addition, a relation of the layer structures is not limited to the structure as shown in FIG. 10, for example, the first electrode plate C1 and the second electrode plate C2 can be made in other layers, as long as the first electrode plate C1 and the second electrode plate C2 can form the two electrode plates of a capacitor. If the light emitting element D is a top-emission structure, that is, the light emitting element D emits light from a side of the cathode layer 23 away from the anode layer 21, each component of the pixel driving circuit can be placed below the light emitting element D; and if the light emitting element D is a bottom-emission structure, that is, the light emitting element D emits light from a side of the anode layer 21 away from the cathode layer 23, each component of the pixel driving circuit is needed to be placed outside of an emission area of the light emitting element D, so that no adverse influence to display will be caused.

The specific structure and working principle of the pixel driving circuit are the same as in the above embodiments, which are not repeated herein.

In the display panel of the present embodiment, when scanning the pixels of an $n^{th}$ row to make the pixels of the $n^{th}$ row enter into the first stage, other rows except the $n^{th}$ row are non-scan rows, pixels of the non-scan rows are in the third stage, and in a pixel driving circuit corresponding to a pixel in the non-scan row, the first node is not in communication with the reset signal line, so that even if the voltage value of the reset signal line is changed, the voltage values of the first nodes in the pixel driving circuits corresponding to other pixels won't be changed, that is, the voltage value of the second node won't be affected, and the brightness of the light emitting element won't be changed, thereby alleviating the problem of non-uniform display.

Figure 11:
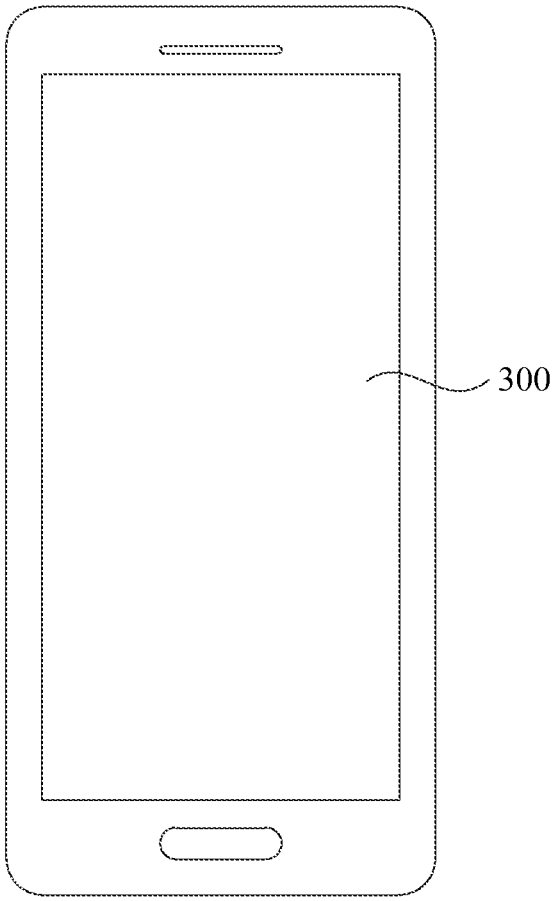
FIG. 11 illustrates a structural schematic diagram of a display device in an embodiment of the present disclosure.

As shown in FIG. 11, which illustrates a structural schematic diagram of a display device in an embodiment of the present disclosure, the embodiment of the present disclosure further provides a display device, including the above described display panel 300.

The specific structure and working principle of the display panel 300 are the same as in the above embodiments, which are not repeated herein. The display device can be any electronic device with a display function, such as touch screen, mobile phone, tablet computer, notebook computer, e-book, and TV.

In the display device of the present embodiment, when scanning the pixels of a $n^{th}$ row to make the pixels of the $n^{th}$ row enter into the first stage, other rows except the $n^{th}$ row are non-scan rows, pixels of the non-scan lines are in the third stage, and in a pixel driving circuit corresponding to the non-scan line, the first node is not in communication with the reset signal line, so that even if the voltage value of the reset signal line is changed, the voltage values of the first nodes in the pixel circuits corresponding to other pixels won't be changed, that is, the voltage value of the second node won't be affected, and the brightness of the light emitting element won't be changed, thereby alleviating the problem of non-uniform display.

Finally, it should be noted that embodiments described above are merely to illustrate technical solution of the present application, and they do not limit the present disclosure. Although the present disclosure is described in detail with reference to the above-mentioned embodiments, it will be understood that one of ordinary skill in the art can still modify or carry out equivalent substitution to part or all technical features of the technical solutions described in above-mentioned embodiments, without departing from the scope of the technical solutions of various embodiments of the present disclosure.

What is claimed is:

1. A display panel, comprising a pixel driving circuit, wherein the pixel driving circuit comprises:

a first switch transistor, a first end of the first switch transistor being electrically connected to a data signal end, a second end of the first switch transistor being electrically connected to a first node, and a control end of the first switch transistor being electrically connected to a first control signal end, and the first switch transistor being-used for transmitting a signal of the data signal end to the first node in response to an enable signal of the first control signal end;

a second switch transistor, a first end of the second switch transistor being electrically connected to a first power source voltage end, a second end of the second switch transistor being electrically connected to the first node, and a control end of the second switch transistor being electrically connected to a second control signal end, and the second switch transistor being-used for transmitting a signal of the first power source voltage end to the first node in response to an enable signal of the second control signal end;

a storage capacitor, a first end of the storage capacitor being electrically connected to the first node, a second end of the storage capacitor being electrically connected to a second node;

a driving transistor, a first end of the driving transistor being electrically connected to the first power source voltage end, a second end of the driving transistor being electrically connected to a third node, a control end of the driving transistor being electrically connected to the second node;

a third switch transistor, a first end of the third switch transistor being electrically connected to the second node, a second end of the third switch transistor being electrically connected to the third node, a control end of the third switch transistor being electrically connected to a third control signal end;

a fourth switch transistor, a first end of the fourth switch transistor being electrically connected to the third node, a second end of the fourth switch transistor being electrically connected to a fourth node, a control end of the fourth switch transistor being electrically connected to a fourth control signal end;

a fifth switch transistor, a first end of the fifth switch transistor being electrically connected to a reset signal line, a second end of the fifth switch transistor being electrically connected to the fourth node, and a control end of the fifth switch transistor being electrically connected to a fifth control signal end, and the fifth switch transistor being used for transmitting a signal of the reset signal line to the fourth node in response to an enable signal of the fifth control signal end;

a light emitting element, an anode of the light emitting element being electrically connected to the fourth node, a cathode of the light emitting element being electrically connected to a second power source voltage end; and a sixth switch transistor, the first end of the driving transistor being electrically connected to the first power source voltage end by the sixth switch transistor, a first end of the sixth switch transistor being electrically connected to the first power source voltage end, a second end of the sixth switch transistor being electrically connected to the first end of the driving transistor, and a control end of the sixth switch transistor being electrically connected to a sixth control signal end, wherein a non-enable signal is provided to the first control signal end and the sixth control signal end, and an enable signal is provided to the second control signal end, the third control signal end, the fourth control signal end and the fifth control signal end in a first stage, so that the signal of the first power source voltage end is transmitted to the first node and the signal of the reset signal line is transmitted to the fourth node, the third node and the second node;

a non-enable signal is provided to the second control signal end and the fourth control signal end, and an enable signal is provided to the first control signal end, the third control signal end, the fifth control signal end and the sixth control signal end in a second stage, so that the signal of the data signal end is transmitted to the first node, a threshold compensation is performed to the second node by the first power source voltage end, and the signal of the reset signal line is transmitted to the fourth node; and a non-enable signal is provided to the first control signal end, the third control signal end and the fifth control signal end, and providing an enable signal to the second control signal end, the fourth control signal end and the sixth control signal end in a third stage, so that the signal of the first power source voltage end is transmitted to the first node and a conduction path between the first power source voltage end and the second power source voltage end is formed.

2. The display panel according to claim 1, wherein the light emitting element of the pixel driving circuit comprises an anode layer, a light emitting layer and a cathode layer, and the anode layer, the light emitting layer and the cathode layer are sequentially placed;

each transistor in the pixel driving circuit comprises a source electrode, a drain electrode, a gate electrode and an active layer;

the storage capacitor comprises a first electrode plate and a second electrode plate; and the gate electrode and the second electrode plate are placed in a first metallic layer, the first electrode plate is placed in a second metallic layer, the source electrode and the drain electrode are placed in a third metallic layer, and the third metallic layer, the second metallic layer, the first metallic layer and the active layer are sequentially placed on a side of the anode layer away from the cathode layer.

3. The display panel according to claim 1, wherein the first switch transistor, the second switch transistor, the third switch transistor, the fourth switch transistor, the fifth switch transistor and the sixth switch transistor are P-type transistors.

4. The display panel according to claim 1, wherein the light emitting element is an organic light-emitting diode.

5. The display panel according to claim 1, wherein the third switch transistor is a multi-gate structure.

6. The display panel according to claim 1, wherein a width-length ratio of a channel of the driving transistor is smaller than 1.

7. A control method for a pixel driving circuit, the pixel driving circuit comprising:

a first switch transistor, a first end of the first switch transistor being electrically connected to a data signal end, a second end of the first switch transistor being electrically connected to a first node, and a control end of the first switch transistor being electrically connected to a first control signal end, and the first switch transistor being used for transmitting a signal of the data signal end to the first node in response to an enable signal of the first control signal end;

a second switch transistor, a first end of the second switch transistor being electrically connected to a first power source voltage end, a second end of the second switch transistor being electrically connected to the first node, and a control end of the second switch transistor being electrically connected to a second control signal end, and the second switch transistor being used for transmitting a signal of the first power source voltage end to the first node in response to an enable signal of the second control signal end;

a storage capacitor, a first end of the storage capacitor being electrically connected to the first node, a second end of the storage capacitor being electrically connected to a second node;

a driving transistor, a first end of the driving transistor being electrically connected to the first power source voltage end, a second end of the driving transistor being electrically connected to a third node, a control end of the driving transistor being electrically connected to the second node;

a third switch transistor, a first end of the third switch transistor being electrically connected to the second node, a second end of the third switch transistor being electrically connected to the third node, a control end of the third switch transistor being electrically connected to a third control signal end;

a fourth switch transistor, a first end of the fourth switch transistor being electrically connected to the third node, a second end of the fourth switch transistor being electrically connected to a fourth node, a control end of the fourth switch transistor being electrically connected to a fourth control signal end;

a fifth switch transistor, a first end of the fifth switch transistor being electrically connected to a reset signal line, a second end of the fifth switch transistor being electrically connected to the fourth node, and a control end of the fifth switch transistor being electrically connected to a fifth control signal end, and the fifth switch transistor being used for transmitting a signal of the reset signal line to the fourth node in response to an enable signal of the fifth control signal end;

a light emitting element, an anode of the light emitting element being electrically connected to the fourth node, a cathode of the light emitting element being electrically connected to a second power source voltage end; and a sixth switch transistor, the first end of the driving transistor being electrically connected to the first power source voltage end by the sixth switch transistor, a first end of the sixth switch transistor being electrically connected to the first power source voltage end, a second end of the sixth switch transistor being electrically connected to the first end of the driving transistor, and a control end of the sixth switch transistor being electrically connected to a sixth control signal end, the control method comprising:

providing a non-enable signal to the first control signal end and the sixth control signal end, and providing an enable signal to the second control signal end, the third control signal end, the fourth control signal end and the fifth control signal end in a first stage, so that the signal of the first power source voltage end is transmitted to the first node and the signal of the reset signal line is transmitted to the fourth node, the third node and the second node;

providing a non-enable signal to the second control signal end and the fourth control signal end, and providing an enable signal to the first control signal end, the third control signal end, the fifth control signal end and the sixth control signal end in a second stage, so that the signal of the data signal end is transmitted to the first node, a threshold compensation is performed to the second node by the first power source voltage end, and the signal of the reset signal line is transmitted to the fourth node; and providing a non-enable signal to the first control signal end, the third control signal end and the fifth control signal end, and providing an enable signal to the second control signal end, the fourth control signal end and the sixth control signal end in a third stage, so that the signal of the first power source voltage end is transmitted to the first node and a conduction path between the first power source voltage end and the second power source voltage end is formed.

8. A control method for a pixel driving circuit, the pixel driving circuit comprising:

a first switch transistor, a first end of the first switch transistor being electrically connected to a data signal end, a second end of the first switch transistor being electrically connected to a first node, and a control end of the first switch transistor being electrically connected to a first control signal end, and the first switch transistor being used for transmitting a signal of the data signal end to the first node in response to an enable signal of the first control signal end;

a second switch transistor, a first end of the second switch transistor being electrically connected to a first power source voltage end, a second end of the second switch transistor being electrically connected to the first node, and a control end of the second switch transistor being electrically connected to a second control signal end, and the second switch transistor being used for transmitting a signal of the first power source voltage end to the first node in response to an enable signal of the second control signal end;

a storage capacitor, a first end of the storage capacitor being electrically connected to the first node, a second end of the storage capacitor being electrically connected to a second node;

a driving transistor, a first end of the driving transistor being electrically connected to the first power source voltage end, a second end of the driving transistor being electrically connected to a third node, a control end of the driving transistor being electrically connected to the second node;

a third switch transistor, a first end of the third switch transistor being electrically connected to the second node, a second end of the third switch transistor being electrically connected to the third node, and a control end of the third switch transistor being electrically connected to the third control signal end;

a fourth switch transistor, a first end of the fourth switch transistor being electrically connected to the third node, a second end of the fourth switch transistor being electrically connected to the fourth node, and a control end of the fourth switch transistor being electrically connected to the fourth control signal end;

a fifth switch transistor, a first end of the fifth switch transistor being electrically connected to a reset signal line, a second end of the fifth switch transistor being electrically connected to the fourth node, and a control end of the fifth switch transistor being electrically connected to a fifth control signal end, and the fifth switch transistor being used for transmitting a signal of the reset signal line to the fourth node in response to an enable signal of the fifth control signal end;

a light emitting element, an anode of the light emitting element being electrically connected to the fourth node, a cathode of the light emitting element being electrically connected to a second power source voltage end;

a sixth switch transistor, the first end of the driving transistor being electrically connected to the first power source voltage end by the sixth switch transistor, a first end of the sixth switch transistor being electrically connected to the first power source voltage end, a second end of the sixth switch transistor being electrically connected to the first end of the driving transistor, and a control end of the sixth switch transistor being electrically connected to a sixth control signal end; and a seventh switch transistor, a first end of the seventh switch transistor being electrically connected to a reference voltage signal end, a second end of the seventh switch transistor being electrically connected to the first end of the driving transistor, and a control end of the seventh switch transistor being electrically connected to a seventh control signal end, and the seventh switch transistor being used for transmitting a signal of the reference voltage signal end to the first end of the driving transistor in response to an enable signal of the seventh control signal end;

wherein the control method comprises:

providing the non-enable signal to the first control signal end, the sixth control signal end and the seventh control signal end, and providing the enable signal to the second control signal end, the third control signal end, the fourth control signal end and the fifth control signal end in the first stage, so that the signal of the first power source voltage end is transmitted to the first node and the signal of the reset signal line is transmitted to the fourth node, the third node and the second node;

providing a non-enable signal to the second control signal end, the fourth control signal end and the sixth control signal end, and providing an enable signal to the first control signal end, the third control signal end, the fifth control signal end and the seventh control signal end in the second stage, so that the signal of the data signal end is transmitted to the first node, a threshold compensation is performed to the second node by the reference voltage signal end, and the signal of the reset signal line is transmitted to the fourth node; and providing a non-enable signal to the first control signal end, the third control signal end, the fifth control signal end and the seventh control signal end, and providing an enable signal to the second control signal end, the fourth control signal end and the sixth control signal end in the third stage, so that the signal of the first power source voltage end is transmitted to the first node and a conduction path between the first power source voltage end and the second power source voltage end is formed.

9. A display panel, comprising a pixel driving circuit, wherein the pixel driving circuit comprises:

a first switch transistor, a first end of the first switch transistor being electrically connected to a data signal end, a second end of the first switch transistor being electrically connected to a first node, and a control end of the first switch transistor being electrically connected to a first control signal end, and the first switch transistor being used for transmitting a signal of the data signal end to the first node in response to an enable signal of the first control signal end;

a second switch transistor, a first end of the second switch transistor being electrically connected to a first power source voltage end, a second end of the second switch transistor being electrically connected to the first node, and a control end of the second switch transistor being electrically connected to a second control signal end, and the second switch transistor being used for transmitting a signal of the first power source voltage end to the first node in response to an enable signal of the second control signal end;

a storage capacitor, a first end of the storage capacitor being electrically connected to the first node, a second end of the storage capacitor being electrically connected to a second node;

a driving transistor, a first end of the driving transistor being electrically connected to the first power source voltage end, a second end of the driving transistor being electrically connected to a third node, a control end of the driving transistor being electrically connected to the second node;

a third switch transistor, a first end of the third switch transistor being electrically connected to the second node, a second end of the third switch transistor being electrically connected to the third node, a control end of the third switch transistor being electrically connected to a third control signal end;

a fourth switch transistor, a first end of the fourth switch transistor being electrically connected to the third node, a second end of the fourth switch transistor being electrically connected to a fourth node, a control end of the fourth switch transistor being electrically connected to a fourth control signal end;

a fifth switch transistor, a first end of the fifth switch transistor being electrically connected to a reset signal line, a second end of the fifth switch transistor being electrically connected to the fourth node, and a control end of the fifth switch transistor being electrically connected to a fifth control signal end, and the fifth switch transistor being used for transmitting a signal of the reset signal line to the fourth node in response to an enable signal of the fifth control signal end;

a light emitting element, an anode of the light emitting element being electrically connected to the fourth node, a cathode of the light emitting element being electrically connected to a second power source voltage end;

a sixth switch transistor, the first end of the driving transistor being electrically connected to the first power source voltage end by the sixth switch transistor, a first end of the sixth switch transistor being electrically connected to the first power source voltage end, a second end of the sixth switch transistor being electrically connected to the first end of the driving transistor, and a control end of the sixth switch transistor being electrically connected to a sixth control signal end; and a seventh switch transistor, a first end of the seventh switch transistor being electrically connected to a reference voltage signal end, a second end of the seventh switch transistor being electrically connected to the first end of the driving transistor, and a control end of the seventh switch transistor being electrically connected to a seventh control signal end, and the seventh switch transistor being used for transmitting a signal of the reference voltage signal end to the first end of the driving transistor in response to an enable signal of the seventh control signal end, wherein a non-enable signal is provided to the first control signal end, the sixth control signal end and the seventh control signal end, and an enable signal is provided to the second control signal end, the third control signal end, the fourth control signal end and the fifth control signal end in a first stage, so that the signal of the first power source voltage end is transmitted to the first node and the signal of the reset signal line is transmitted to the fourth node, the third node and the second node;

a non-enable signal is provided to the second control signal end, the fourth control signal end and the sixth control signal end, and an enable signal is provided to the first control signal end, the third control signal end, the fifth control signal end and the seventh control signal end in a second stage, so that the signal of the data signal end is transmitted to the first node, a threshold compensation is performed to the second node by the reference voltage signal end, and the signal of the reset signal line is transmitted to the fourth node; and a non-enable signal is provided to the first control signal end, the third control signal end, the fifth control signal end and the seventh control signal end, and an enable signal is provided to the second control signal end, the fourth control signal end and the sixth control signal end in the third stage, so that the signal of the first power source voltage end is transmitted to the first node and a conduction path between the first power source voltage end and the second power source voltage end is formed.

10. The display panel according to claim 9, wherein the light emitting element of the pixel driving circuit comprises an anode layer, a light emitting layer and a cathode layer, and the anode layer, the light emitting layer and the cathode layer are sequentially placed;

each transistor in the pixel driving circuit comprises a source electrode, a drain electrode, a gate electrode and an active layer;

the storage capacitor comprises a first electrode plate and a second electrode plate; and the gate electrode and the second electrode plate are placed in a first metallic layer, the first electrode plate is placed in a second metallic layer, the source electrode and the drain electrode are placed in a third metallic layer, and the third metallic layer, the second metallic layer, the first metallic layer and the active layer are sequentially placed on a side of the anode layer away from the cathode layer.

11. The display panel according to claim 9, wherein the first switch transistor, the second switch transistor, the third switch transistor, the fourth switch transistor, the fifth switch transistor, the sixth switch transistor and the seventh switch transistor are P-type transistors.

12. The display panel according to claim 9, wherein the light emitting element is an organic light-emitting diode.

13. The display panel according to claim 9, wherein the third switch transistor is a multi-gate structure.

14. The display panel according to claim 9, wherein a width-length ratio of a channel of the driving transistor is smaller than 1.

* * * * *